United States Patent [19]

Hackman

[11] Patent Number: 5,040,773

[45] Date of Patent: Aug. 20, 1991

[54] METHOD AND APPARATUS FOR TEMPERATURE-CONTROLLED SKULL MELTING

[75] Inventor: Lloyd E. Hackman, Worthington, Ohio

[73] Assignee: Ribbon Technology Corporation, Gahanna, Ohio

[21] Appl. No.: 399,957

[22] Filed: Aug. 29, 1989

[51] Int. Cl.[5] ..... B22D 41/005

[52] U.S. Cl. ..... 266/87; 222/592; 266/275

[58] Field of Search ..... 266/46, 241, 275, 78, 266/87; 222/592; 164/258; 432/42, 48, 262

[56] References Cited

U.S. PATENT DOCUMENTS

| | | | |
|---|---|---|---|
| Re. 27,945 | 3/1974 | Hunt et al. | 164/258 |
| 764,332 | 7/1904 | Baggaley | 266/241 |
| 3,157,922 | 11/1964 | Gruber | 266/241 |
| 3,429,972 | 2/1969 | De Bussy | 222/592 |
| 3,843,106 | 10/1974 | Nanjyo et al. | 266/241 |
| 4,498,610 | 2/1985 | Wooding | 222/592 |
| 4,724,985 | 2/1988 | Dessar | 222/592 |

*Primary Examiner*—S. Kastler

*Attorney, Agent, or Firm*—Frank H. Foster

[57] ABSTRACT

The invention relates to a method and apparatus for controlling the temperatures of a plurality of zones of a casting hearth or vessel. The invention also relates to a method for controlling the thickness of the solidified skull of castable material in the casting hearth or vessel. By the present invention, the efficiency of the skull casting process can be significantly improved by reducing the thickness of the skull and thereby increasing the amount of castable material which can remain molten and pourable.

11 Claims, 5 Drawing Sheets

METHOD AND APPARATUS FOR TEMPERATURE-CONTROLLED SKULL MELTING

TECHNICAL FIELD

This invention relates generally to a method for independently controlling the temperatures in various segments of a skull melting cooled hearth or vessel.

BACKGROUND OF THE INVENTION

Metal has long been melted by many useful techniques including batch processing techniques, in which the melt is poured in discrete batches, and by continuous techniques. The melting energy in the known systems is provided by various techniques such as induction, electric arc, gas, and energy beams.

One melting technique, known as skull melting, utilizes a hearth cavity commonly heated by a radiant beam, such as, for example, an electron beam. In skull melting, a certain portion of the melted metal is allowed to freeze in the hearth cavity to form a lining or skull along the inner surface of the hearth cavity because the melting temperature of the metal being melted may be higher than the melting temperature of the hearth and also the metals are frequently too reactive to be in contact with other substances. In skull melting, the metal being poured is then contained in the hearth or vessel and skull of frozen material of the same metal. Thus to avoid the formation of, for example, undesirable oxides or other side products, the metals are melted in and poured from a skull of the same material, and often under an inert atmosphere, such as, but not limited to, nitrogen, helium, or argon. The molten metal is then poured out of the skull cavity, often onto a ribbon making or strip making or filament making device.

It is desirable to have the skull as thin as possible to minimize the unused metal and improve pour efficiency. However, it is often difficult to control the thickness of the solidified skull. It is also difficult to control the uniformity of the cooling around the perimeter of the skull, and thus the rate of freezing of the skull sections. Conventionally, the radiant beam is repositioned frequently to attempt to melt or remelt the metal being cast, but such spot heating does not lead to uniform heating or cooling and can result in poor melting efficiency.

In addition, the continued freezing of more molten metal reduces the efficiency of the skull casting technique to the point that it is common for up to about 80% of the metal contained in the hearth to ultimately remain frozen as the skull.

U.S. Pat. No. 4,469,162, issued Sep. 4, 1984 to Hanas et al., teaches the use of a ladle with a temperature sensor and control of the heat input to the ladle.

U.S. Reissue Pat. No. 27,945, issued Mar. 26, 1974 to Hunt et al., teaches the use of a skull-type system in which the observation is made that the skull thickness is dependent upon heat removal which can be regulated to control the desired thickness of the cast part.

U.S. Pat. No. 4,674,556, issued June 23, 1987 to Sakaguchi et al., teaches the supply of water to a roller and a temperature detector which is used to control the supply rate of cooling water in non-skull melting systems.

U.S. Pat. No. 4,483,387, issued Nov. 20, 1984 to Chieler's et al., teaches the use of a continuous casting mold in which the temperatures of different sections of the mold are independently controlled by calculating the quantity of cooling water delivered to each of the sections.

Thus a need exists for a method and apparatus for the controlled heating and cooling of skull melting whereby the thickness of the solidified skull and the width and depth of the molten material can be easily adjusted. It is desirable to control the skull thickness and to adjust the temperature without causing the mold or hearth to melt, degrade, or deform. It is also desirable to minimize the thickness of the skull to thereby increase the effiency of the skull melting process by allowing more of the castable metal to obtain, a molten state.

SUMMARY OF THE INVENTION

The present invention relates to a method of controlling the temperatures of a plurality of sections of a melting vessel or hearth, wherein each section is provided with a means for independently controlling the delivery of heat transfer medium to said section of the melting hearth or vessel. Each section of the melting hearth or vessel can further. comprise a temperature sensing device able to sense the temperature of the section, and provide a corresponding output such as an electrical, electronic, or radio signal. In this manner the thickness of the frozen skull of material being cast is readily controlled.

DETAILED DESCRIPTION

Figure 1:
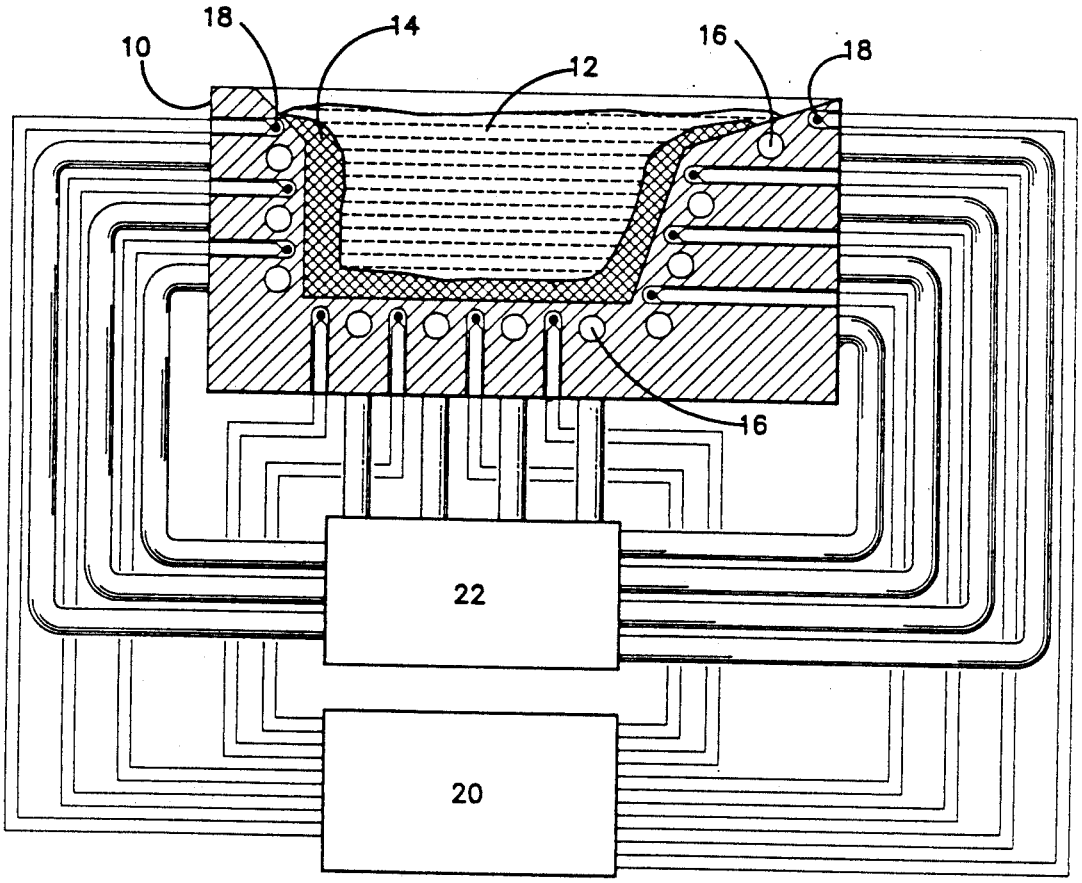
FIG. 1 is a schematic view of a temperature controlled skull casting apparatus embodying the invention.

In FIG. 1 is presented one embodiment of the present invention for a controlled temperature skull casting apparatus. The melting hearth, vessel, or tundish 10 defines a cavity or well into which is placed the castable material 12. The molten castable material freezes to a certain extent along the surface of the melting hearth cavity to form a skull of frozen castable material 14. The melting hearth contains heat transfer elements 16 which are located throughout the hearth. The melting hearth also contains holes drilled from the outside surfaces into which may be placed the temperature sensing devices 18. The temperature sensing devices 18 are connected to or otherwise communicate with a control unit 20 which receives and interprets the temperature signals from the temperature sensing devices 18. The control unit 20 is connected to or otherwise communicates with a heat transfer medium supplying means 22 which, in response to signals from the control unit 20, increases or decreases the volume or rate of flow or both of a heat transfer medium into the heat transfer elements 16.

Figure 2:
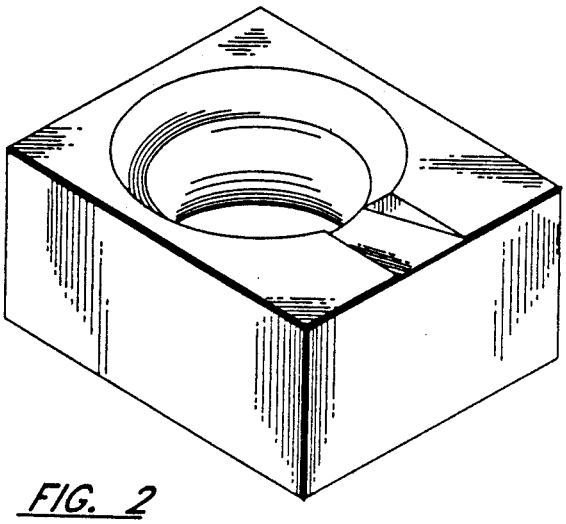
FIG. 2 is an illustration of the melting hearth portion of the temperature controlled skull casting apparatus simplified by the deletion of the heat transfer elements and the temperature sensing devices.

FIG. 2 shows a simplified illustration of the melting hearth without the heat transfer elements or temperature sensing devices being visible. A heating source such as an electron beam, would be movably mounted above the cavity of the hearth to heat the castable material placed therein.

Figure 3:
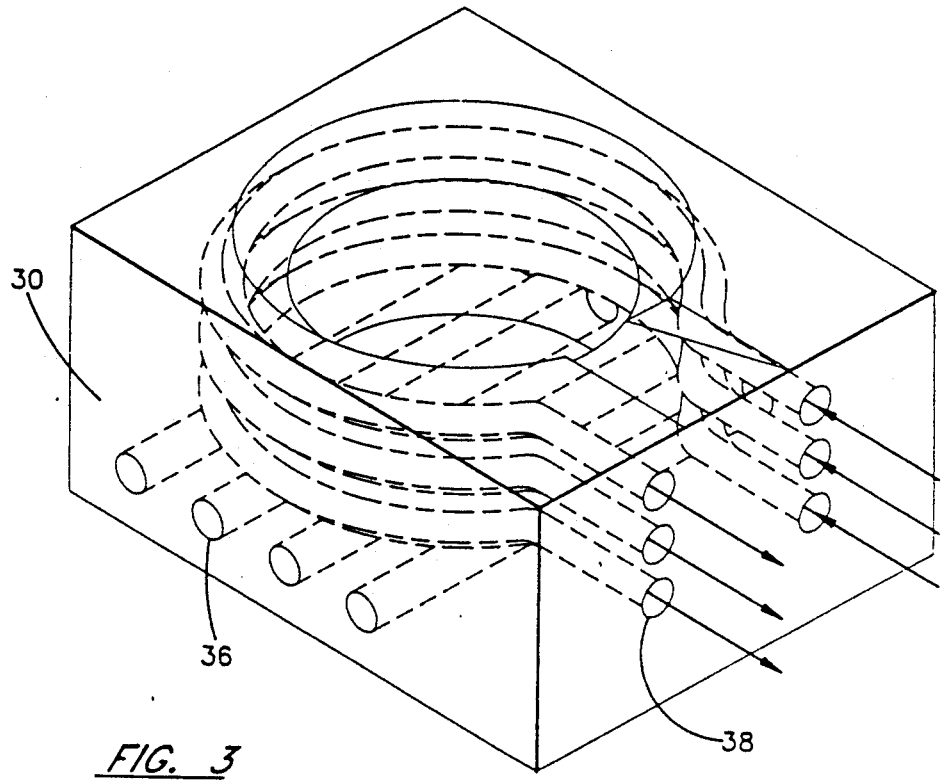
FIG. 3 is an illustration of the melting hearth portion of a temperature controlled skull casting apparatus depicting horizontal and also circular heat transfer elements and simplified by the deletion in the illustration of the tundish bowl and the temperature sensing devices.

FIG. 3 shows a simplified illustration of the melting hearth without the tundish bowl or temperature sensing devices being visible. Horizontal heat transfer elements 36 are shown traversing the tundish 30. Circular heat transfer elements 38 are shown circling the volume of the tundish bowl, not shown. Heat transfer medium is pumped through either horizontal heat transfer elements 36 or circular heat transfer elements 38, or both. Temperature sensing devices, not shown in FIG. 3, are attached to the tundish in the manner described above.

Figure 4:
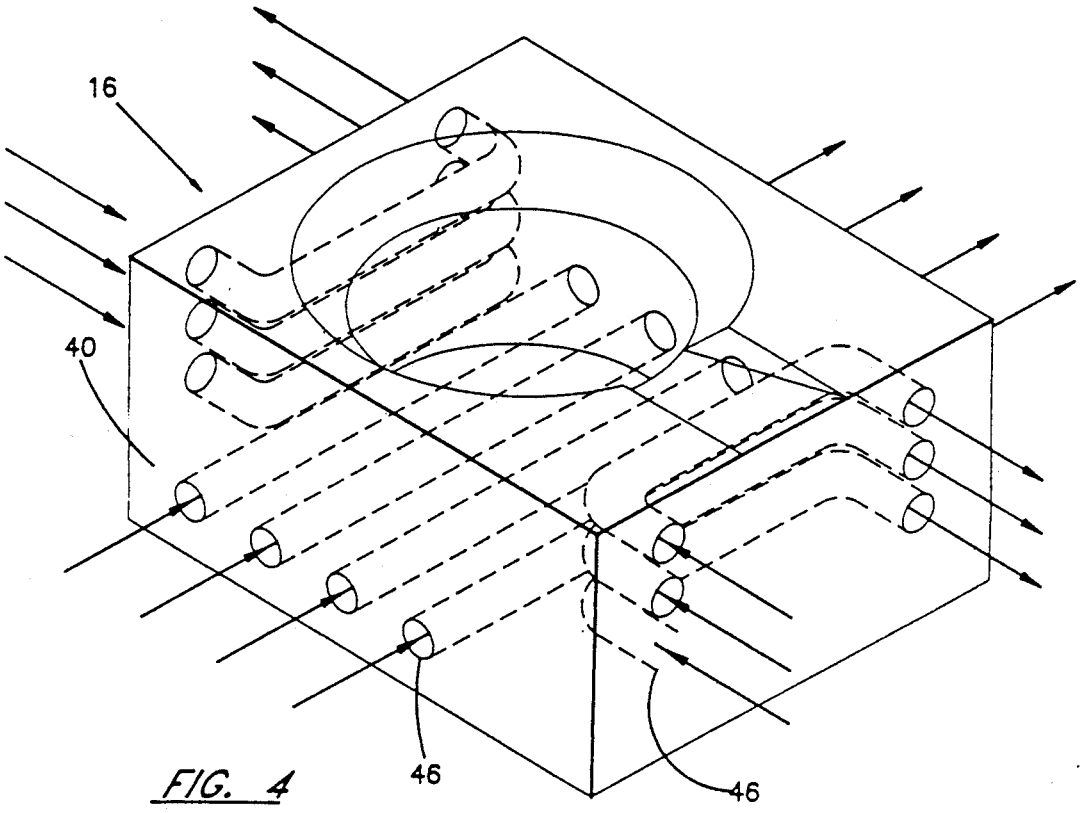
FIG. 4 is an illustration of the melting hearth portion of a temperature controlled skull casting apparatus depicting horizontal and also semi-circular heat transfer elements and simplified by the deletion in the illustration of the temperature sensing devices.

FIG. 4 shows a simplified illustration of the melting hearth without temperature sensing devices being visible. Horizontal heat transfer elements 46 are shown traversing the tundish 40. Semi-circular heat transfer elements 46 also convey heat transfer medium through the tundish 40. Temperature sensing devices, not shown in FIG. 4, are attached to the tundish in the manner described above.

Figure 5:
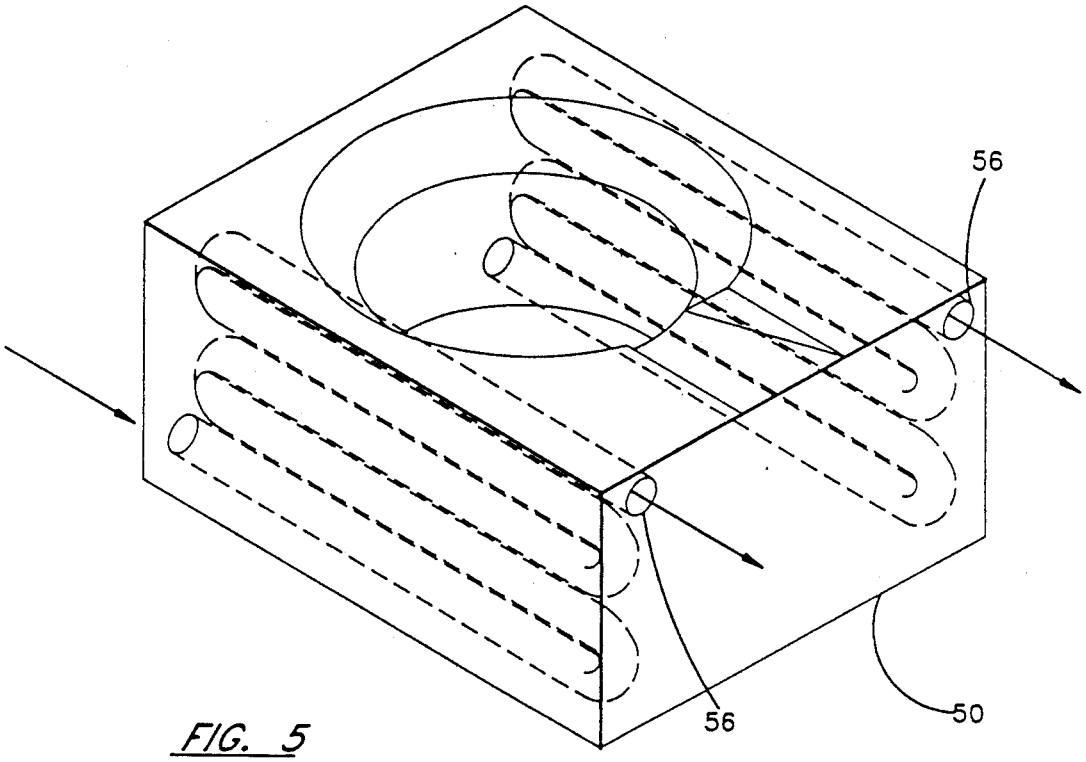
FIG. 5 is an illustration of the melting hearth portion of a temperature controlled skull casting apparatus depicting vertically coiled heat transfer elements and simplified by the deletion in the illustration of the tundish bowl and the temperature sensing devices.

FIG. 5 shows a simplified illustration of the melting hearth without the tundish bowl or temperature sensing devices being visible. "S-shaped" heat transfer elements 56 are shown on either side of the tundish 50 adjacent the location of the tundish bowl, not shown. Heat transfer medium is pumped through the "S-shaped" heat transfer elements 56. Temperature sensing devices, not shown in FIG. 5, are attached to the tundish in the manner described above.

Figure 6:
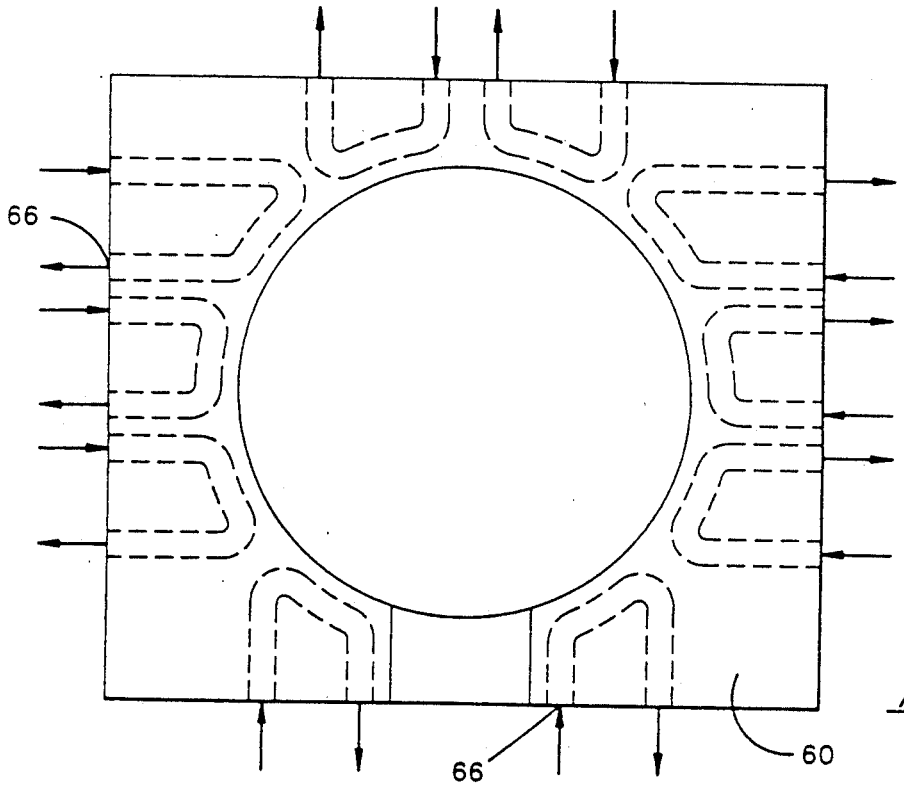
FIG. 6 is a top view of a melting hearth portion of a temperature controlled skull melting apparatus depicting heat transfer elements and simplified by the deletion in the illustration of the temperature sensing devices.

FIG. 6 shows a top view of the tundish bowl of the melting hearth 60 and several heat transfer elements 66. Temperature sensing devices, not shown in FIG. 6, are attached to the tundish in the manner described above.

Figure 7:
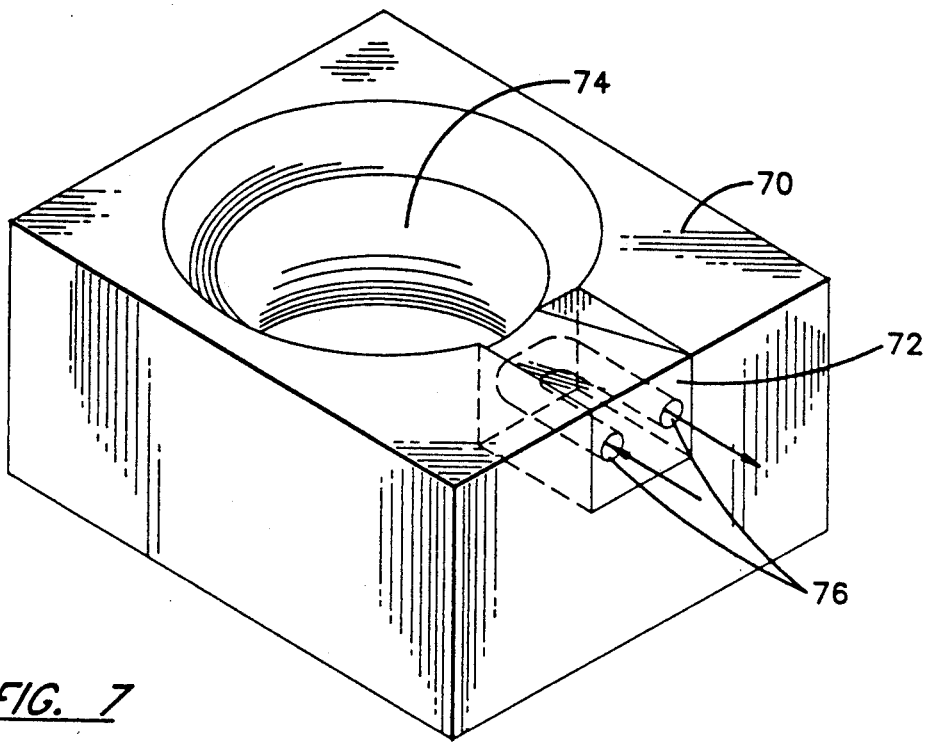
FIG. 7 is an illustration of the melting hearth portion of a temperature controlled skull casting apparatus depicting a temperature controlled exit or pouring lip, simplified by the deletion in the illustration of the temperature sensing devices.

FIG. 7 shows a simplified illustration of the melting hearth without temperature sensing devices being visible. The tundish bowl 74 of the melting hearth 70 is lined with a ceramic material. A temperature controlled segment 72 is located beneath the exit or pouring lip and is preferably formed of a metallic material capable of efficient heat transfer. A preferred metallic material for the temperature controlled segment 72 and/or the exit lip is copper. The temperature controlled segment 72 is depicted in FIG. 7 as a hollow chamber into which can be introduced through heat transfer elements 76 a heat transfer medium for the selective cooling of the exit lip or pouring lip area. In an alternative embodiment not depicted in FIG. 7, the temperature controlled segment 72 is not hollow but contains a series of heat transfer elements arranged in a desired configuration whereby cooling of the exit lip is achievable.

Figure 8:
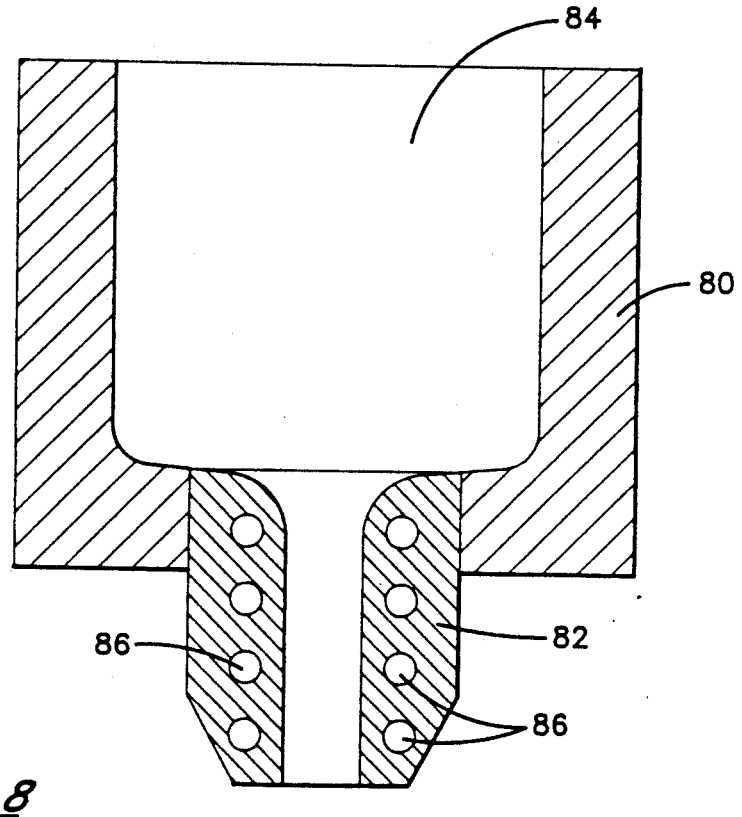
FIG. 8 is a cross section view of a bottom pour casting apparatus simplified by the deletion of the temperature sensing devices but showing the heat transfer elements in the nozzle at the bottom of the tundish bowl.

FIG. 8 shows a simplified illustration of a bottom pour melting hearth without temperature sensing devices being visible. The tundish bowl 84 of the melting hearth 80 is preferably lined with a ceramic or metallic material. A temperature controlled segment exit lip 82 is located beneath the tundish bowl and is preferably formed of a metallic material capable of efficient heat transfer. A preferred metallic material for the temperature controlled segment 82 is copper. The temperature controlled segment 82 contains heat transfer elements 86 through which a heat transfer medium can be circulated for the selective cooling of the exit lip or pouring lip 82. The "exit lip" or "pouring lip" of FIG. 8 and FIG. 9 can also be described as a nozzle, as will be apparent to those skilled in the art.

Figure 9:
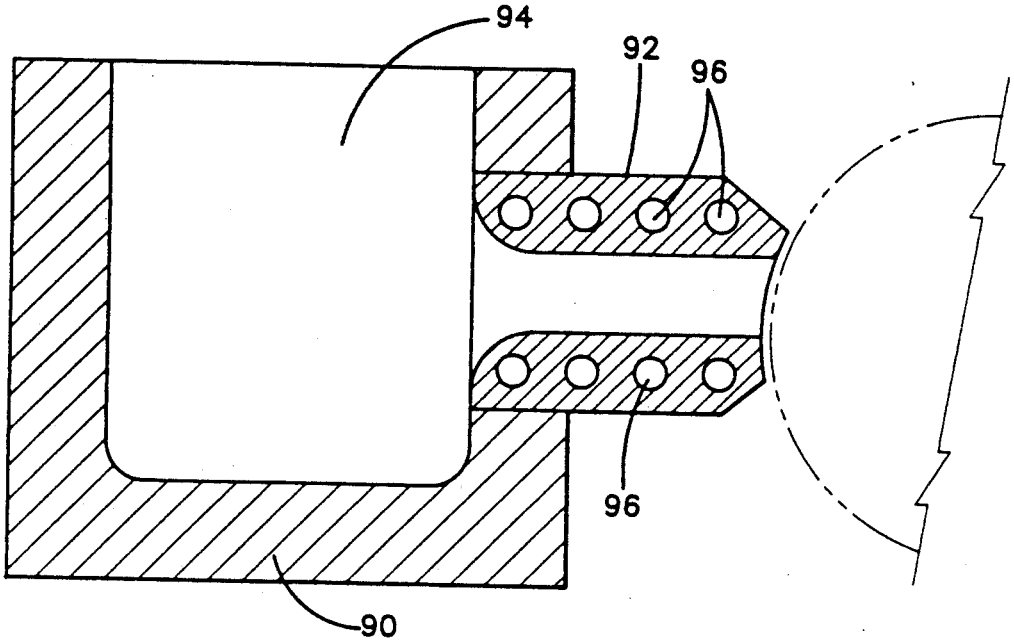
FIG. 9 is a cross section view of a side pour casting apparatus simplified by the deletion of the temperature sensing devices but showing the heat transfer elements in the nozzle at the side of the tundish bowl.

FIG. 9 shows a simplified illustration of a side pour melting hearth without temperature sensing devices being visible. The tundish bowl 94 of the melting hearth 90 is preferably lined with a ceramic or metallic material. A temperature controlled segment exit lip 92 is located at the side of the tundish bowl and is preferably formed of a metallic material capable of efficient heat transfer. A preferred metallic material for the temperature controlled segment 92 is copper. The temperature controlled segment 92 contains heat transfer elements 96 through which a heat transfer medium can be circulated for the selective cooling of the exit lip or pouring lip 92.

Figure 10:
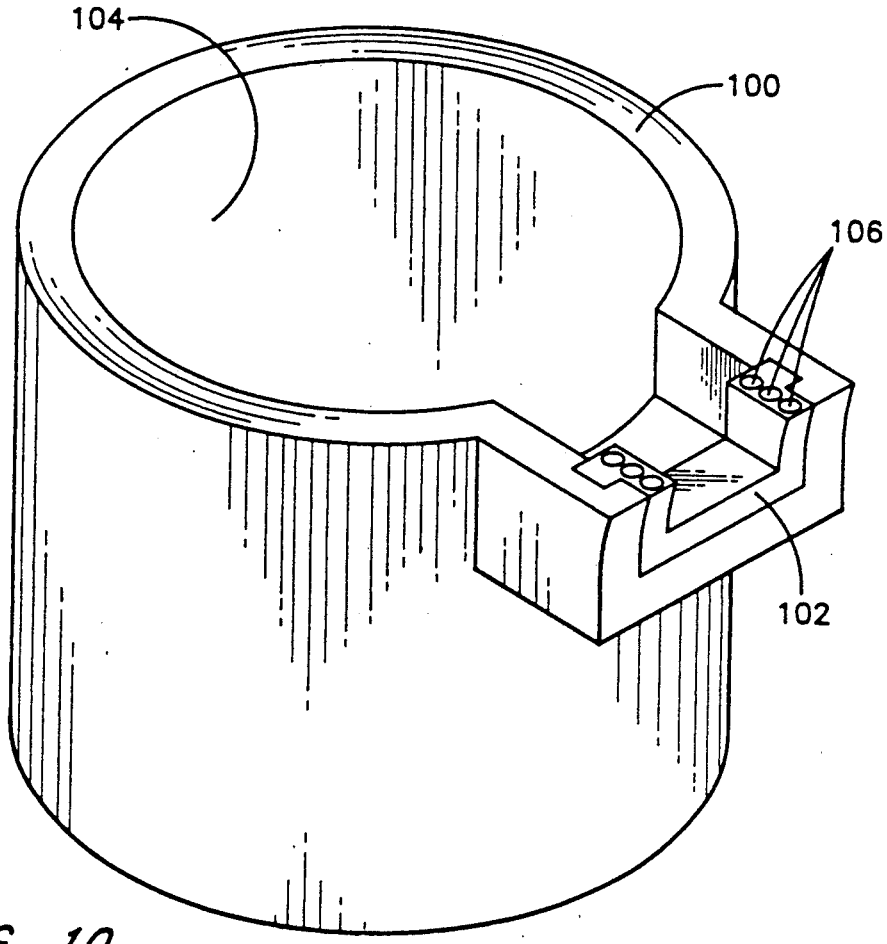
FIG. 10 is an illustration of the melting hearth portion of a temperature controlled melt overflow skull casting apparatus depicting a temperature controlled metal exit or pouring lip, simplified by the deletion in the illustration of the temperature sensing devices.

FIG. 10 shows a simplified illustration of a melt overflow hearth without temperature sensing devices being visible. The tundish bowl 104 of the melting hearth 100 is preferably lined with a ceramic material. A temperature controlled segment 102 is located at the exit or pouring lip and is preferably formed of a metallic material capable of efficient heat transfer. A preferred metallic material for the temperature controlled segment 102 and/or the exit lip is copper. The temperature controlled segment 102 is depicted in FIG. 10 as a metallic liner or insert in the pouring lip and containing a plurality of heat transfer elements 106 into which can be introduced a heat transfer medium for the controlled cooling of the exit lip or pouring lip area. In an alternative embodiment not depicted in FIG. 10, the temperature controlled segment 102 is hollow whereby cooling of the exit lip is achievable by circulating a heat transfer medium, such as water, through the hollow segment 102.

In one embodiment of the present invention, a hearth, tundish, or vessel with a cavity is provided, wherein the hearth comprises a plurality of segments or sections which are contiguous on the interior surface of the cavity and wherein the sections may each contain embedded within the walls of the hearth at least one temperature sensing device. The temperature sensing device can be, for example, a thermocouple device or a transducer device positioned deep within the mold material. Other temperature sensing devices capable of detecting or recording or signaling temperatures or variations thereof are also envisioned as useful herein. The temperature sensing devices within each segment preferrably deliver a signal, corresponding in a direct or indirect manner to the temperature of the segment, to a control unit able to receive and integrate the temperature signals. The signals can be digitalized, direct current, alternating current, or any other electronic or electrical or electromagnetic signal, such as radio waves. By use of electromagnetic signalling, direct hookup connections are not needed between the control unit and the mechanism designed as a means for controlling the flow of the heat transfer medium.

The control unit which receives the signal from each temperature sensing device in each segment of the melting hearth or vessel can be, for example, a computer or a microprocessor. The control unit then preferrably transmits a response signal to a mechanism designed as a means for supplying and/or controlling volume and/or flow rate of a heat transfer medium, such as a cooling or warming liquid, which passes through each section of the hearth or vessel. The computer or microprocessor operating as the control unit can be programmed to maintain each section of the hearth or vessel at a certain temperature or within a certain temperature range. The various sections of the hearth or vessel may thus by design be maintained at different temperatures by the present invention through programming of the control unit. In this manner, and according to a predetermined desired warming or cooling rate, the cooling of the molten material in the melting hearth or vessel is controlled at each section simultaneously and independently. This allows an operator to control the thickness of the solidified metal or skull material at all locations throughout the hearth cavity, rather than just at any single point where the heat source, such as the electron beam or plasma arc, is targeted.

The present invention also allows the preprogramming into the computer or microprocessor of a desired schedule of heating and/or cooling sequential steps or cycles.

The heat transfer medium can be useful herein to warm certain portions or segments of the hearth cavity or to cool certain portions or segments of the hearth cavity by conveying heat energy from one section of the hearth to another. It may be desirable to use a heat transfer medium to preheat, for example, the pouring lip of the hearth, which may be located a distance away from the pool of molten metal within the skull, while at the same time maintaining the temperature of or even cooling certain segments of the hearth so as to independently control the skull thickness at all points of the hearth cavity. The preheating of a certain portion of the hearth can be achieved, for example, by shunting or diverting heat transfer medium from an area in the hearth of high temperature to an area of lower temperature by means of the heat transfer medium elements. This can be done according to the present invention by signals from the computer or microprocessor in response to temperature variations.

The heat transfer medium can be a cooling or warming gas or liquid such as water or aqueous solutions of various materials including but not limited to selected salts. A preferred heat transfer medium is a material which does not expand significantly upon heating, has a high heat capacity, and does not decompose or degrade at the temperatures near the melting point of the metal being cast. Low toxicity and low corrosivity are also desirable properties in the heat transfer medium. Thus preferred heat transfer media are water, polyoxyalkylenes, phenoxyalkylenes, polyglycols, halogenated hydrocarbons, and silicones. Silicones useful herein as heat transfer medium materials can include but are not limited to dimethylpolysiloxanes, phenylmethylpolysiloxanes, phenoxyalkylpolysiloxanes, alkoxyalkylpolysiloxanes, alkoxyphenylpolysiloxanes, and mixtures thereof.

The means for controlling the volume or flow rate or both of the heat transfer medium can be any conventional pump, flow meter, servo-motor, or other device known by or obvious to the skilled artisan, wherein said device is capable of initiating, maintaining, increasing, decreasing, or stopping the flow of the heat transfer medium. Not to be viewed as a limitation herein, one example of such a means for controlling the volume or flow rate of the heat transfer medium is a centrifugal pump attached to a variable speed motor.

In one embodiment of the present invention, a block of metal, such as copper, aluminum, or molybdenum is cast or drilled so as to possess a mold cavity of desired volume and shape. Into the metal block from the outside and not from within the mold cavity are drilled several tap holes into which can be placed the temperature sensing devices. It is preferred that the holes be drilled to such a depth that the temperature sensing devices can be placed into the holes at a position equal to or less than about one eighth of an inch from the inner surface of the mold cavity. It is desirable to place the temperature sensing devices as close to the surface of the skull mold face as possible without disrupting the continuous surface of the skull mold. The distances between the temperature sensing devices is not critical herein and can vary across the dimensions of the melting hearth vessel and also vary according to the criticality of the temperature control required with a particular castable material.

At a distance of from, for example, about one sixteenth of an inch to about one inch from the temperature sensing holes are located within each section of the hearth or vessel the heat transfer medium passages or elements through which the heat transfer medium can be circulated. The heat transfer medium elements can be tubes or holes of varying diameters and configurations. The heat transfer medium elements are preferrably located no closer than one half to three fourths of an inch from the surface of the hearth cavity. The heat transfer medium elements preferrably run parallel to the surface being heated or cooled thereby, so as to maximize the heating or cooling efficiency. The size, number, and configuration of the heat transfer medium elements are not limitations to the invention and can vary according to the desired heating and cooling efficiency or size of batch by methods and theory known to those skilled in the art. The heat transfer medium elements can thus be, for example, loops, repeated coils, or other patterns designed to efficiently connect, conduct, or convey heat into or out of the hearth or vessel. The heat transfer elements can also be arranged beneath the exit or pouring lip of the hearth or vessel such that a skull or partial skull of frozen material can be generated on the surfaces of the exit lip.

The flow rate of the heat transfer medium can by the present invention control the temperature of the various sections of a melting hearth or vessel. Thus a slow rate of flow of a heat transfer medium will produce a higher temperature within the hearth or segment because less heat is being carried from the segment per unit of time by the heat transfer medium. Similarly, a fast rate of flow of a heat transfer medium will produce a lower temperature within the hearth or vessel segment because more heat is being carried from the segment per unit of time. In a like manner, a slow rate of flow of a heat transfer medium from a first segment to a second segment, wherein the medium has been heated by the first segment to a temperature above the temperature of the second segment of the hearth or vessel, will produce a slow and/or low temperature increase within the particular second segment because heat is being carried more slowly toward the segment. Similarly, a fast rate of flow of a warming heat transfer medium will produce a higher temperature within the receiving segment because more heat is being carried toward the particular segment per unit of time.

Thus the present invention relates to a method of independently controlling the temperatures of a plurality of sections of a skull melting hearth possessing a hearth cavity, wherein each section of the melting hearth comprises at least one heat transfer medium element through which a heat transfer medium can be delivered, and a heat transfer medium supplying means for independently controlling the heat transfer medium delivery to said section of the melting hearth, said method comprising the steps:

a) delivering a castable material to the hearth cavity of the skull melting hearth;

b) optionally heating or cooling the castable material; and, c) delivering heat transfer medium independently and as desired to the heat transfer elements of separate sections of the melting hearth. In this manner, the skull of solidified castable material desired for the protection of the castable material from the surface of the hearth cavity can be maintained at a minimum.

In addition to controlling the thickness of the skull of frozen or solidified castable material by means of delivering or diverting heat transfer medium to or within the heat transfer medium elements of each segment, the skull thickness of the castable material may also be controlled by conventional heating means, such as, but not limited to, radiant beam, such as a plasma arc or electron beam. The invention, however, focuses on controlling independently and simultaneously the temperatures of several sections of the melting hearth by controlling the delivery of heat transfer medium to the melting hearth through the heat transfer elements.

In one embodiment of the present invention, each section of the melting hearth further comprises a temperature sensing device.

Thus, according to the present invention, the thickness of the skull of frozen material containing a pool of molten castable material is readily controlled, and ideally minimized to thereby increase the efficiency of the process. The larger pool of molten castable material can by this invention be more easily poured out of, or caused to overflow from, the cavity of the melting hearth onto, for example, rolls for producing ribbon, filaments, fiber, or film from the molten material.

The present invention further relates to a skull melting apparatus, comprising: a hearth or vessel cavity for retaining molten material, wherein the hearth or vessel comprises a plurality of sections or zones; at least one temperature sensor in each section or zone of the hearth or surrounding the vessel cavity; at least one heat transfer medium element in each section of the hearth or vessel cavity through which a heat transfer medium can be delivered; a heat transfer medium supplying means for independently controlling the heat transfer medium delivered to each section of the hearth or vessel.

In one embodiment of the apparatus of the present invention, the apparatus further comprise a computer or microprocessor which is programmed to detect or receive signals related to the temperature of each of a plurality of segments of the melting hearth. The computer then coordinates the responsive flow rates of heat transfer medium into each segment through the heat transfer medium elements.

In another embodiment of the present invention, the hearth or vessel cavity is lined with a ceramic or refractory material such as, but not limited to, alumina or magnesia, or mixtures thereof. Thus in another embodiment, the hearth or vessel is lined with a ceramic material while the exit lip, formed from a metallic material such as but not limited to copper, is cooled from beneath by heat transfer elements which surround or innervate the metallic material of the exit lip.

In another embodiment, the hearth or vessel cavity is lined with a porous mat or matrix having the same composition as the castable material, whereby the mat or matrix acts as an insulator between the molten castable material and the surface of the hearth or vessel cavity to thereby help reduce heat flow from the molten castable materials to the hearth or vessel cavity surface.

The castable materials which are used in the apparatus and method of the present invention include any meltable material. Preferred castable materials are metals, metal alloys, or mixtures thereof.

While certain preferred embodiments of the present invention have been disclosed in detail, it is to be understood that various modifications may be adopted without departing from the spirit of the invention or scope of the following claims.

That which is claimed is:

1. A skull melting, casting hearth apparatus for independently controlling the temperature of each of a plurality of individual hearth zones to independently control the skull thickness associated with each zone, the apparatus comprising:

(a) a casting hearth having a cavity for retaining molten material, the hearth cavity wall comprising a plurality of zones;

(b) at least one independent heat transfer medium conducting element in each zone through which a heat transfer fluid can be delivered;

(c) a heat transfer medium supplying means connected to supply heat transfer medium to each of said medium conducting elements at independently variably controlled flow rates; and (d) a temperature sensing divide in each zone of the hearth cavity for detecting the temperature of each zone to permit control of the zone temperature by control of the flow rate in response to a signal from said temperature sensing device.

2. The casting hearth apparatus of claim 1 further comprising a control unit for controlling the heat transfer medium supplying means in response to signals from the temperature sensing device.

3. The casting hearth apparatus of claim 2 wherein the control unit is a computer or a microprocessor.

4. The casting hearth apparatus of claim 3 wherein the temperature sensing device is a thermocouple.

5. The casting hearth apparatus of claim 1 wherein the material fo the cavity is selected from the group consisting of copper, aluminum, and molybdenum.

6. The casting hearth apparatus of claim 1 further comprising a plasma arc heating source.

7. The casting hearth appartus of claim 1 further comprising a electron beam heating source.

8. The casting hearth apparatus of claim 1 wherein the cavity is lined with refractory ceramic material.

9. The casting hearth apparatus devices of claim 1 wherein each temperature sensing device is mounted in a hole in each zone of the hearth at a position equal to or less than about one eighth of an inch from the inner surface of the cavity.

10. The casting hearth device of claim 1 wherein the heat transfer medium element in each zone of the hearth is a configuration of tubes through which the heat transfer medium can flow.

11. The casting hearth device of claim 1 further comprising an exit lip for removing the molten material retained in the cavity, wherein the exit lip is lined with a metallic material and is cooled by at least one of said heat transfer elements located near said exit lip.

* * * * *